United States Patent [19]

Sayer

[11] 4,050,280

[45] Sept. 27, 1977

[54] ROD ROLLING

[75] Inventor: Raymond Oliver Sayer, Townsville, Australia

[73] Assignee: M.I.M. Rolling Consultants (H.K.) Limited, Hong Kong, Hong Kong

[21] Appl. No.: 647,770

[22] Filed: Jan. 9, 1976

Related U.S. Application Data

[63] Continuation of Ser. No. 489,059, July 16, 1974, abandoned.

[30] Foreign Application Priority Data

Aug. 6, 1973 Australia ..... 4351/73

[51] Int. Cl.[2] ..... B21B 1/04

[52] U.S. Cl. ..... 72/234; 72/366

[58] Field of Search ..... 72/205, 225, 234

[56] References Cited

U.S. PATENT DOCUMENTS

| | | | |
|---|---|---|---|
| 186,561 | 1/1877 | Hickman | 72/225 |
| 3,358,358 | 12/1967 | Jenks et al. | 72/205 X |
| 3,600,924 | 8/1971 | Martin | 72/234 |
| 3,848,447 | 11/1974 | Strandell | 72/199 |

OTHER PUBLICATIONS

"Developing Non-Ferrous Wire Rod Manufacture" by R. D. Weber, The Wire Industry, Feb., 1968, (Copies in Pittsburgh Library & Lib. of Cong.).

*Primary Examiner*—Milton S. Mehr
*Attorney, Agent, or Firm*—Stevens, Davis, Miller & Mosher

[57] ABSTRACT

A method and apparatus for the reduction rolling of metal rod out of billets, ingots, continuously cast bar and like starting elements, in and by which the stock to be reduced is sent through a sequential series of roll-stands each having a pair of reduction rolls and an entry guide to direct the stock into the nip of the rolls. Some, most or all of the rolls are cylindrical, parallel and devoid of grooves; the stock is shaped by rolling so that upon arrival at and upon departure from each pair of grooveless rolls it has a cross-sectional profile having a major axis which is from one and one half to two and one half times longer than a minor axis at right angles to the major axis. The stock so shaped is presented to the grooveless rolls so that its minor axis is substantially parallel to the work surfaces of the rolls.

2 Claims, 4 Drawing Figures

ROD ROLLING

This is a continuation of application Ser. No. 489,059, filed July 16, 1974, now abandoned.

This invention relates to the reduction rolling of rods, bars and the like (hereinafter referred to simply as "rod" or "rods") for metal billets, ingots, slabs, wirebars, continuously cast bars and like "starting" elements whereof the transverse cross-sectional dimensions are massively greater than those required of the rod to be produced.

The term "metal" a used herein is intended to include alloys, and the term "stock" is herein applied to the metal being reduced at any stage in its formation from the initial starting element form to the final rod form.

In the prior art the usual practice in the reduction rolling of rod from a starting element, is to send the stock through a sequential series of roll-stands each incorporating a pair of circumferentially grooved rolls.

The grooves in the rolls are of a pre-determined profile (e.g. diamond, square, oval, etc.) intended to encourage plastic flow of the metal with optimum contribution to the essential requirement of transverse area reduction of the stock accompanied by longitudinal extension thereof. The number of reduction roll-stand passes is variable, depending on the cross-sectional dimensions of the starting elements and those required of the final product; a typical installation (one, for example, to form circular copper rod of 8mm, diameter from a wirebar of which the cross-sectional shape is square, or trapezoidally nearly square, with sides of about 100mm.) may perform nine roll-stand reduction passes in a roughing mill, four reductions in an intermediate mill and three reductions in a finishing mill.

It will be seen that when using grooved rolls the overall attenuation and lateral dimensional reduction of the through-going stock necessitates the machining and setting up of the roll grooves with great accuracy, and as the leading end of the stock approaches each roll-stand it must be directed, by the use of entry guides, precisely into axial alignment with a pair of roll grooves to receive it. It is also critically important that the stock size presented to each pass is of such a cross sectional area that during the plastic flow of the metal, the stock will not overfill the complementary pair of roll grooves which define the rolling space. The requirements of the prior art are not easily established or maintained, and the main object of the present invention is to eliminate or substantially diminish need for observance of those requirements. This object is achieved by the present invention in its provision of a rod rolling method which can be carried into practical effect by the surprisingly simple expedient of using, in some, most or all of the reduction roll-stands, reduction rolls which are of a plain cylindrical form entirely devoid of circumferential grooves; and by so selecting the cross-sectional profile dimensions of the stock as it arrives at and departs from the grooveless rolls as will give optimum efficiency to the rolling procedure.

It will be appreciated that where the finally-formed finished rod is required to be of some specific cross-sectional shape (e.g. circular) the final finishing roll-stand may be conventionally grooved to accord with that shape. Similarly, the initial roughing roll-stand may be of the conventional kind used for conditioning a starting element, so far as its transverse cross-sectional shape or profile is concerned, for its ready acceptance by the remainder of the mill run. For example, copper wirebars are usually cast as of a trapezoidal cross-sectional shape so that they are readily ejected from the casting mould, and thus the first roughing roll-stand may be not only a reduction roll-stand, but also, one for re-shaping the wirebar to bring it more nearly to a square or other regular rectangular profile.

All of the roll-stands intermediately of the first and the last are preferably equipped with grooveless rolls as referred to above. However, it will be seen from the following description that fewer than all of the intermediate roll-stands may be equipped with grooveless rolls and the advantages due to the invention thereby fractionally but still usefully realized.

It will be clear to those skilled in the art that the work-useful effect of running a piece of stock between a pair of grooveless reduction rolls is to reduce its cross-sectional area, primarily by an extension of its length in the direction of stock travel, combined with some degree of lateral spread in the direction parallel to the surfaces of the rolls.

It follows that the problem to be overcome by present applicant in his proposal to use grooveless rolls for reducing stock to rod form, consisted in so employing the inescapable external spreading effect (referred to above) that in each roll-stand employing grooveless rolls the stock reduction constitutes a step of maximum effectiveness in a progression of steps evolving towards and culminating in a required rod form.

The present invention provides a simple solution to the problem just referred to and consists in a method of reduction rolling of metal rod from a stock initially constituted by a starting element of relatively large transverse cross-sectional area, said method comprising:

a. sending said stock longitudinally through a sequential series of roll-stands including at least one roll-stand comprising two cylindrical parallel, grooveless rolls and an entry guide able to support said stock as it arrives at said rolls;

b. shaping said stock prior to its arrival at said entry guide so that it has a transverse cross-sectional profile having a minor axis being the least dimension of the profile, and a major axis substantially at right angles to said minor axis, said major axis being from $1\frac{1}{2}$ to $2\frac{1}{2}$ times longer than said minor axis;

c. presenting said stock to said grooveless rolls by way of said entry guide so that on the upstream side of said rolls the said minor axis is substantially parallel to the work surfaces of said rolls; and, d. spacing said rolls apart to an extent such that the transverse cross-sectional area of the downstream stock departing from said rolls is less than that of the upstream stock approaching said rolls, and such that the lateral dimension of said departing stock parallel to said upstream minor axis is from one and one half to two and one half times longer than the lateral dimension of said departing stock parallel to said upstream major axis.

By comparison with the prior art practice of using circumferentially grooved rolls in the formation of rods, the present invention affords a number of important advantages; for example:

1. As previously indicated herein, difficulties can arise in conventional "groove" rod rolling if two companion roll grooves are slightly out of mutual register, or if the entry guide for those grooves is slightly out of alignment relative to the grooves, or if the rolls are set a fraction too closely together so that the oncoming stock tends to over-fill the grooves which constitute the rolling space. If any of these difficulties arise, they tend to cause fin-like excresences running longitudinally of the stock; these becomes compressively infolded and compacted during subsequent reduction thus to form, in the finished rod, longitudinal faults or cracks commonly known as "folds" or "laps". The use of grooveless rolls according hereto eliminates these defects simply because the absence of roll grooves provides no basis for their onset.

2. The method subject hereof, for a given rod forming run, consumes less power to operate the mill. It will be clear that in "groove" rolling, because the rolls rotate while the stock moves linearly, the different radii of the groove side-walls cause extensive frictional scuffing of the through-going stock; moreover, the groove side-walls exert substantial components of compressive loading on the stock directly between them. These components are in direct opposition and hence they perform some degree of useless work on the stock. By the present invention, frictional scuffing of this kind is eliminated and the work put into the stock is primarily manifested as free plastic flow of the metal, because the work loading applied to the stock is applied in a single direction (normal to the roll work surface) without mutually opposing compressive loadings and without any restraint upon plastic spread of the metal in the direction parallel to the roll work surface. In other words, the prior art technique of rod formation by use of grooved rolls flows from the concept that to diminish the cross-sectional area of a piece of stock (which is the prime necessity in any reduction process) it is considered essential to exercise containment of the stock so that under the variously directed compressive loadings applied to it during "groove" rolling, the metal is caused, as much as possible, to migrate (initially at least) wholly inwardly towards its own longitudinal centre-line, or rather that of the stock. This prior concept of seeking to deny radially outward or spreading migration of metal particles, appears, on the face of it, to be almost irresistible engineering common sense. Obviously, one could expect, if the whole object of a reduction process is to reduce a starting element of relatively large cross-sectional dimensions to a rod of such smaller like dimensions, it to be almost axiomatic that the total compressive loadings applied to the stock should be such as to squeeze it inwardly into smaller compass, with circumferential totality, or in as many inward directions as is possible, so that the metal flow will be ultimately manifested entirely as a longitudinal extension of the stock.

The present invention is sharply distinguishable from the prior concept of rod-rolling as just discussed, in that in each roll-stand in a sequential series thereof (or in as many of them as is practicable) compressive loading is applied to the stock in only one direction (normal to the work surfaces of the grooveless rolls); and, in the direction at right angles to that one direction, substantial lateral spreading of the stock is not merely permitted, but is wholly unrestrained; the amount of free stock-spreading in the second dimension being limited (to what will be manageable in the next downstream roll-stand) not by any restraint imposed on spreading of the stock, but merely by so spacing the two members of a pair of grooveless rolls that the lateral spreading effect ceases of its own accord, simply because the force previously operating to cause it expires or ceases to operate before excessive lateral spreading takes place.

3. Experiment has shown that by the method of this invention, in which lateral spreading of the stock is permitted, a given rod forming run may be performed with fewer reduction roll-stands. For example, in the instance briefly referred to earlier herein (reduction of a copper wirebar to rod of 8mm. diameter) sixteen roll-stands using grooved rolls were employed in conventional manner. By use of the present invention fourteen roll-stands were sufficient; all of these, except for the first or initial re-shaping roll-stand and the last or final finishing roll-stand, were equipped with grooveless rolls and were operated in accordance with the method subject hereof. This saving in the number of roll-stands, although not great, is nevertheless important because equipment is expensive. The saving is largely due to the fact that the use of grooveless rolls diminishes the number of imponderable factors to be taken into mathematical consideration when computing the optimum amount of draft (metal reduction) per pass. With grooved rolls the effective roll diameter is indeterminate because metal working occurs not only at the root diameter of the grooves but also along the groove side-walls. With plain cylindrical ungrooved rolls the effective roll diameter can be measured exactly, and hence ideal drafting readily computed.

4. When a grooveless roll becomes worn it can be readily trued and re-dressed by simple grinding, whereas with grooved rolls, wear in the grooves requires re-dressing more frequently, largely because of frictional wear due to scuffing action, and when the work has to be done it involves extensive and relatively complex machining to reform the grooves accurately.

5. Because grooveless rolls can be redressed by simple grinding, their working surfaces can be made as hard as it is practical to make them thus extending the useful work periods between redressings.

6. With grooveless rolls the periods between redressings are further extended because the entire cylindrical surface of the rolls may be usefully employed by simple translational adjustment of the entry guides axially of the rolls. With grooved rolls the only usable work surfaces are those constituted by the groove floors and side walls.

7. With conventional grooved rolls the grooves in each reduction pass have to be designed specifically for the particular task in hand; for example, in the production of 8mm. rod. Some adjustment of the rolls can be made to compensate for non-excessive groove wear and the like, but if a difficult task is to be performed (production of 10, 12 or 13mm. rod for example) the whole sequence of rolls may have to be changed, or some the roll-stands inconveniently by-passed; whereas with grooveless rolls only the final finishing roll-stand need be replaced. All that is necessary in all the other roll-stands is simple spacing adjustment of each roll pair, or elimination of any roll-stand then becoming unnecessary.

8. In grooveless rolling, the stock leaving any pair of grooveless rolls necessarily has two opposite surfaces which are both flat and parallel, thus giving a symmetrical and constant geometric shape affording enhanced stock stability in the entry guides, by comparison with the oval, diamond and other cross-sectional shapes commonly produced by grooved rolls in an endeavour to achieve maximum metal draft per pass. This enhanced stability, in turn helps to ensure accurately oriented presentation of the stock to be rolls directly associated with the particular entry guide.

Further description of the present invention will now be in terms of the drawings herewith.

Figure 1:
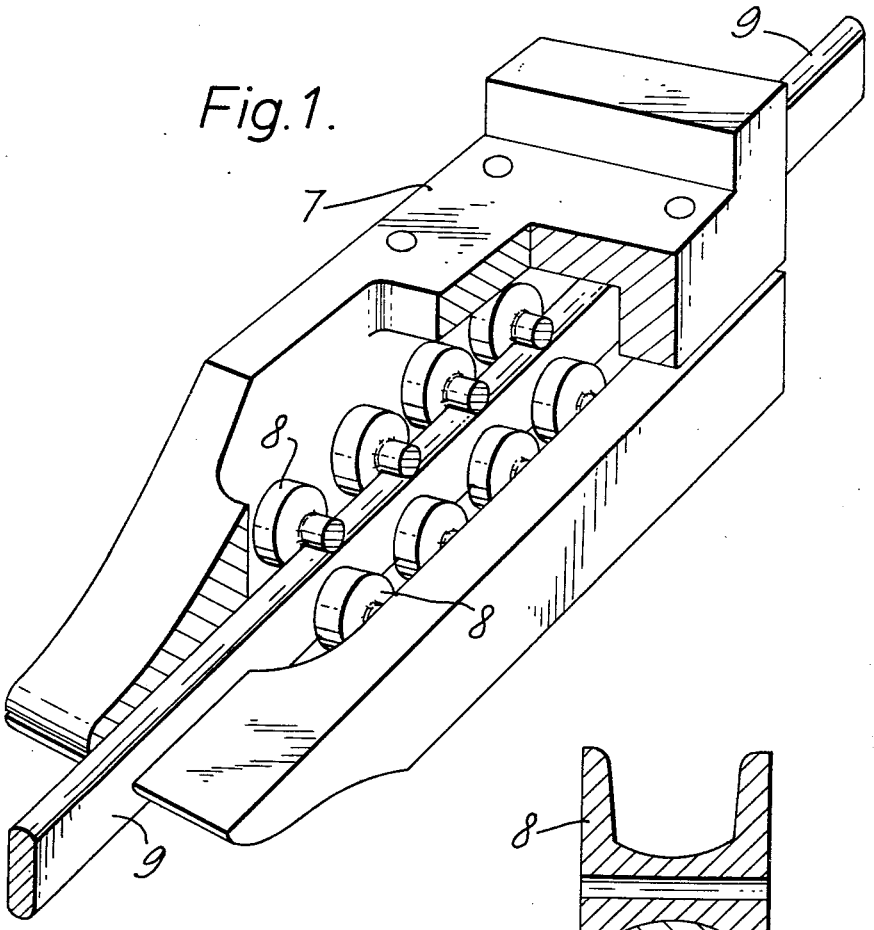
FIG. 1 is a partly sectioned perspective view of one form of entry guide which may be used in performing the rod rolling method subject hereof.

Referring to the drawings, the roll-stands for each reduction pass may be of conventional design, insofar as each consists of a pair of reduction rolls, mounting and driving arrangements for the rolls and an entry guide for presenting the stock to the rolls.

Figure 2:
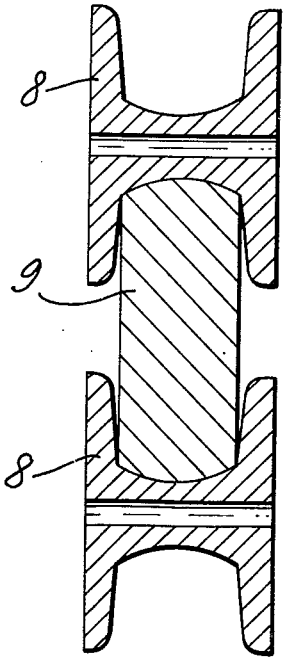
FIG. 2 is a medial section through one pair of entry guide rollers showing a piece of groovelessly rolled stock therebetween. Four such pairs of rollers are shown in FIG. 1.

The entry guides may be of any conventional type, for example they may be of the kind shown in FIGS. 1 and 2, each guide consisting of an open-ended box-like body 7 providing a mounting for a plurality of paired guide rollers 8 which are grooved and spaced apart to accommodate and support the through-going stock indicated at 9. If, as is preferred, grooveless rolling according hereto is carried out in conjunction with the method subject of our co-pending U.S. patent application, Ser. No. 306,409 (filed 14th Nov. 1972) now U.S. Pat. No. 3,818,744, June 25, 1974) the entry guide rollers may be double-grooved and otherwise of the kind discribed and illustrated in that application.

Figure 3:
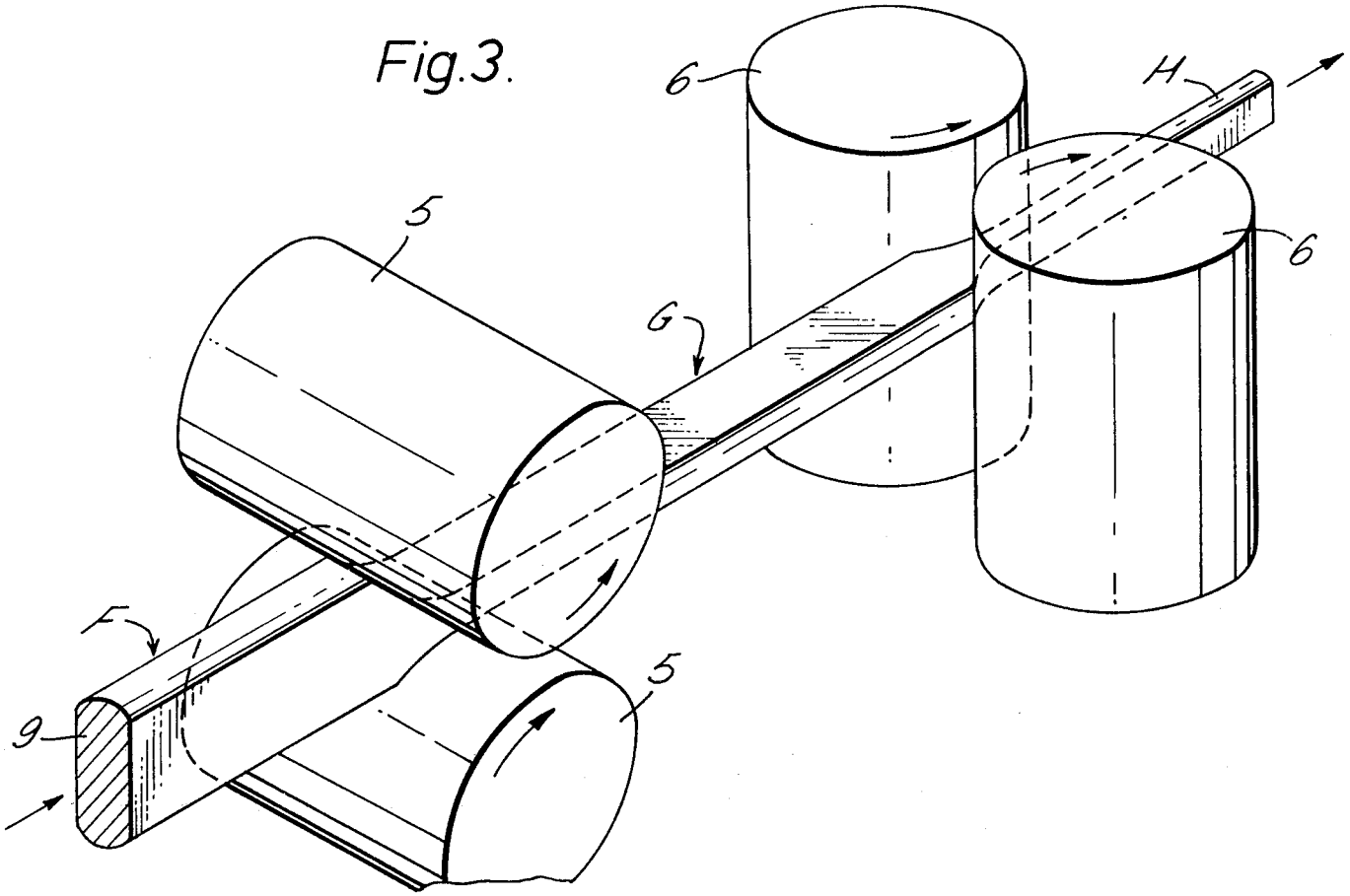
FIG. 3 is a perspective schematic showing of two such neighbouring stages in the grooveless rolling of stock entry guides being omitted.

It will be noted from FIG. 3 that the axes of the rolls 5 are disposed at right-angles to the axes of the rolls 6 in the neighbouring roll-stand. It is preferred that such an arrangement, in which alternate roll-stands have the roll axes phased at 90° to each other, be employed. Such an arrangement is already in common use in conventional "groove" rolling mills, these being known as "alternate horizontal/vertical rolling mills." Alternatively, the roll axes throughout the mill array may be parallel and means provided to twist the stock through 90° between neighbouring roll-stands. This also is a well-known expedient.

Figure 4:
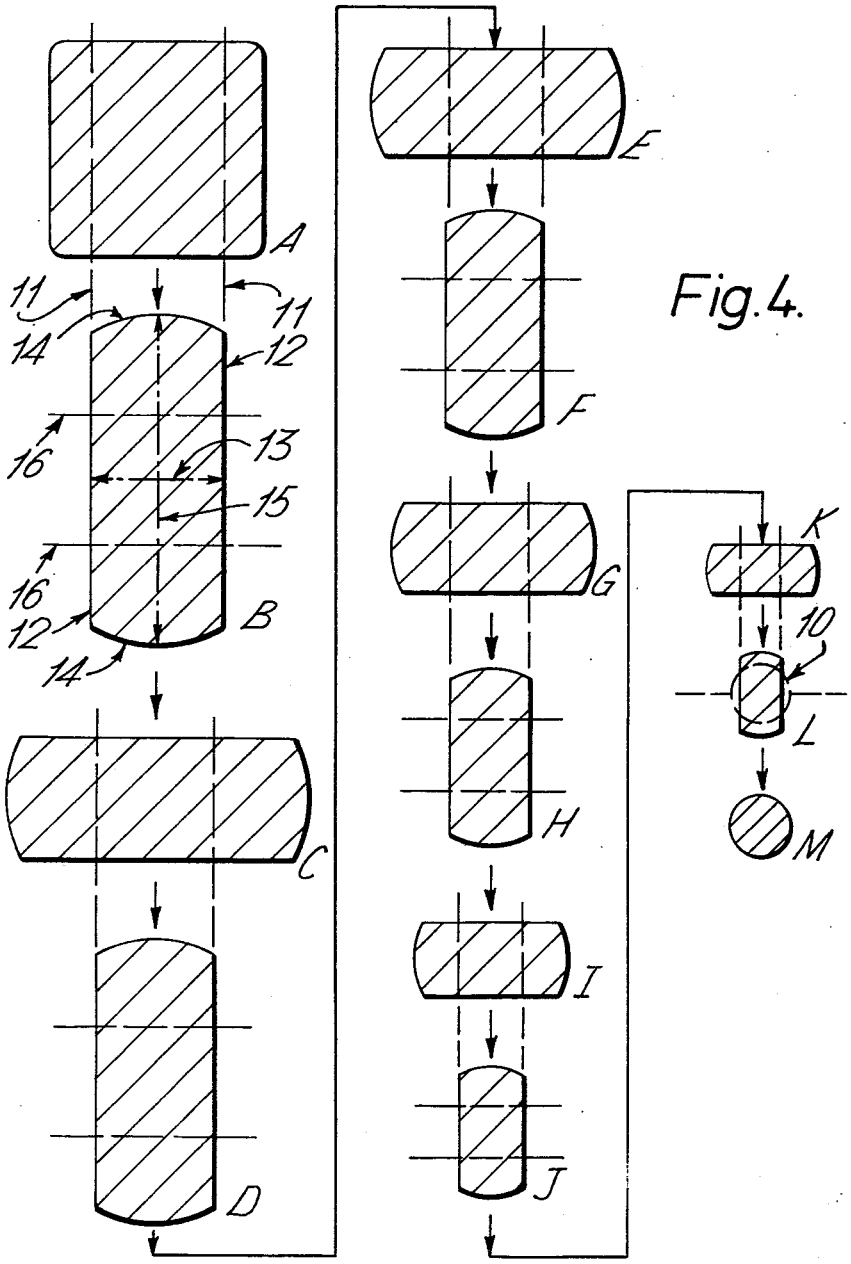
FIG. 4 shows a typical sequence of stock profiles in which all reduction other the last are performed by grooveless rolling.

It will be understood that the number of roll-stands or reduction stages in a full rod-rolling operation will largely depend upon the transverse dimensions of the starting elements and those required of the finished rod. The sequence shown in FIG. 4 illustrates a starting element profile A which is substantially square, eleven intermediate four-sided profiles B to L and a finished rod profile M. FIG. 3 may be regarded as another showing of three of these profiles; for example F, G and H.

As previously indicated, it is desirable for as many as possible of the reduction passes to be performed "groovelessly", although if only one of the passes were to be so performed some fractional benefit would derive.

In FIG. 4 all except the last pass (to reduce profile L to a rod profile M) are performed groovelessly. It will be obvious however, that if rods of profile L constitute a useful commodity them all of the passes could be grooveless. For example, steel rods to be used purely as tension members could very well be of the form indicated by profile L; indeed, under those circumstances, a rod form such as L may be preferred as its flat sides would facilitate bolt-hole drilling, clamp attachment or welding to other structural elements, and so on.

Where however a final rod form such as M is required, it is desirable for the last reduction pass to be performed by ordinary grooved rolls as indicated by dotted lines 10 applied to profile L.

As with the last pass (L to M) the first pass may also be performed by use of conventional rolls, particularly where the first pass is one of re-shaping the starting element rather than one of reducing its transverse cross-sectional area. For example, the first pass for a copper wirebar of trapezoidal profile (to bring it to a rectangular, or near rectangular profile) could, if desired, be performed with conventional rolls.

Still referring to FIG. 4, the starting element A is re-shaped by subjecting it to grooveless-roll singly-directed compression, the working surfaces of the rolls being indicated by dotted lines 11. If this pass is purely or largely one of re-shaping, the resulting stock profile B will be of about the same area as profile A. On the other hand, some degree of stock reduction may be performed by way of this initial pass. In either case the spacing of roll surfaces 11 is such that the resulting profile B is a four-sided profile having two, flat and parallel opposite sides 12 the distance between which is equal to the minor axis indicated at 13, and two outwardly bulged opposite sides 14 the maximum distance between which is equal to the major axis indicated at 15.

Experiment has shown that the length of a major axis such as 15 should not be more than about two and one half times the length of the companionate minor axis 13, otherwise there is a risk of the stock becoming phase disoriented as it enters the nip of the next (downstream) pair of grooveless rolls. On present indications, the optimum ratio (so far at least as copper stock is concerned) between the major axis and the minor axis is about 2.1 : 1.0.

In the sequence of FIG. 4, stock of profile B is unidirectionally compressed between the grooveless roll surfaces indicated at 16 so to bring the stock to profile C. In this profile (and subsequent downstream profiles) the ratio between the major and minor axes is preferably 2.1 : 1 as explained above. The subsequent passes (profiles D to L) are performed in the same way. The final pass (from profile L to profile M) may be purely a re-shaping pass or one in which both re-shaping and reduction occurs.

It will be appreciated that the sequence of passes illustrated in FIG. 4 represent what would be known in the art as "heavy" or "severe" drafting; that is an unusually extensive reduction of stock cross-sectional area per pass. We have however, that presentation of stock with a high aspect ratio (2.1 : 1 for example, as discussed above) to plain cylindrical rolls, by way of an appropriate entry guide, gives satisfactory stability of the through-going stock; that is, without tendancy on the part of the stock to learn or collapse sidewardly relative to the reduction rolls. It would appear that this heavy drafting is practicable due to the avoidance (as discussed above) of any restraint upon lateral spread of the stock.

Heavy drafting is of course, all to the good where possible, as it enables the transformation of the starting element to the final rod form with fewer passes. It will be clear however that the method subject hereof is equally applicable where less drastic or even "light" drafting is preferred; as, for example, in the production of rod from special steels or other metals generally regarded as not readily amenable to rod-rolling procedures.

It will be appreciated that the present invention is applicable in both hot or cold rod-rolling. Cold rolling being definable as metal deformation at temperatures below which restoration processes, such as recovery or re-crystallisation do not occur within a resonable time (for example, in the time interval between successive passes), and hot rolling being that performed at some temperature (other than cold as just defined) at which re-crystallisation can occur.

I claim:

1. A method of reduction of metal rod from stock initially of relative large transverse cross-sectional area, said method comprising:

shaping said stock into a substantially rectangular transverse cross-sectional profile, the longer sides of which are from one and one-half to two and one-half times larger than the shorter sides; then guiding the stock into the space between a first pair of spaced parallel grooveless rolls with the shorter sides disposed substantially parallel to the work surfaces of the rolls and rollingly compressing the stock through the pair of rolls and with that pair of rolls only while not restraining lateral spreading thereof to reduce the length of the longer sides and increase the length of the shorter sides to the extent that the transverse cross-sectional area of the stock departing from said rolls is less than that of the stock approaching the rolls and the transverse cross-sectional profile of the stock departing from the rolls is substantially rectangular with the longer sides thereof substantially parallel to the work surfaces of the rolls and from one and one-half to two and one-half times longer than the shorter sides thereof substantially perpendicular to the work surface of the rolls; then guiding the stock into the space between a second pair of spaced parallel grooveless rolls with the last-mentioned shorter sides disposed parallel to the work surfaces of the second rolls and rollingly compressing the stock through the second pair of rolls and the with second pair of rolls only while not restraining lateral spreading thereof to reduce the length of the last-mentioned longer sides and increase the length of the last-mentioned shorter sides to the extent that the transverse cross-sectional area of the stock departing from said second pair of rolls is less than that of the stock approaching said second pair of rolls and the transverse cross-sectional profile of the stock departing from the second pair of rolls is substantially rectangular with the longer sides thereof substantially parallel to the work surfaces of the second pair of rolls and from one and one-half to two and one-half times longer than the shorter sides thereof substantially perpendicular to the work surfaces of the second pair of rolls.

2. A method of reduction rolling of metal rod from stock initially of relatively large transverse cross-sectional area, said method comprising:

shaping said stock into a substantially rectangular transverse cross-sectional profile, the longer sides of which are substantially 2.1 times larger than the shorter sides; then guiding the stock into the space between a first pair of spaced parallel grooveless rolls with the shorter sides disposed substantially parallel to the work surfaces of the rolls and rollingly compressing the stock through the pair of rolls and with the pair of rolls only while not restraining lateral spreading thereof to reduce the length of the longer sides and increase the length of the shorter sides to the extent that the transverse cross-sectional area of the stock departing from said rolls is less than that of the stock approaching the rolls and the transverse cross-sectional profile of the stock departing from the rolls is substantially rectangular with the longer sides thereof substantially parallel to the work surfaces of the rolls and substantially 2.1 times longer than the shorter sides thereof substantially perpendicular to the work surfaces of the rolls; then guiding the stock into the space between a second pair of spaced parallel grooveless rolls with the last-mentioned shorter sides disposed parallel to the work surfaces of the second rolls and rollingly compressing the stock through the second pair of rolls and with the second pair of rolls only while not restraining lateral spreading thereof to reduce the length of the last-mentioned longer sides and increase the length of the last-mentioned shorter sides to the extent that the transverse cross-sectional area of the stock departing from said second pair of rolls is less than that of the stock approaching said second pair of rolls and the transverse cross-sectional profile of the stock departing from the second pair of rolls is substantially rectangular with the longer sides thereof substantially parallel to the work surfaces of the second pair of rolls and substantially 2.1 times longer than the shorter sides thereof substantially perpendicular to the work surfaces of the second pair of rolls.

* * * * *